US008836231B2

(12) United States Patent
Bradford

(10) Patent No.: US 8,836,231 B2
(45) Date of Patent: Sep. 16, 2014

(54) MODULARIZED LED LAMP

(75) Inventor: Everett Bradford, Durham, NC (US)

(73) Assignee: Cree, Inc., Durham, NC (US)

( * ) Notice: Subject to any disclaimer, the term of this patent is extended or adjusted under 35 U.S.C. 154(b) by 398 days.

(21) Appl. No.: 13/218,557

(22) Filed: Aug. 26, 2011

(65) Prior Publication Data

US 2013/0049603 A1 Feb. 28, 2013

(51) Int. Cl.
*H05B 33/02* (2006.01)
*H05B 33/08* (2006.01)

(52) U.S. Cl.
CPC ..... *H05B 33/0854* (2013.01)
USPC ..... 315/291; 315/307; 315/308

(58) Field of Classification Search
USPC ..... 315/291, 307, 308, 149, 158, 159, 151, 315/152, 155, 154, 153
See application file for complete search history.

(56) References Cited

U.S. PATENT DOCUMENTS

| | | | | |
|---|---|---|---|---|
| 7,658,527 | B2 | 2/2010 | Gwatkin, III | |
| 7,777,166 | B2 | 8/2010 | Roberts | |
| 8,330,377 | B2 * | 12/2012 | Marson | 315/127 |
| 2009/0020684 | A1 | 1/2009 | Shih et al. | |
| 2010/0277077 | A1 | 11/2010 | Pong et al. | |
| 2010/0320939 | A1 | 12/2010 | Lai | |
| 2012/0146548 | A1 * | 6/2012 | Campbell et al. | 315/297 |

FOREIGN PATENT DOCUMENTS

WO 2011024098 A1 3/2011

OTHER PUBLICATIONS

Cree, Inc., International Application No. PCT/US2012/051527, International Search Report and Written Opinion, Oct. 24, 2012.

* cited by examiner

*Primary Examiner* — David H Vu
(74) *Attorney, Agent, or Firm* — Steven B. Phillips; Moore & Van Allen PLLC

(57) ABSTRACT

A modularized LED lamp is disclosed. Embodiments of the present invention provide an LED lamp in which digital and/or analog communication takes place between the LED module and the power supply unit (PSU) of the lamp. A controller in the LED module sends signals to the PSU, allowing separation of the two parts so that each part can be manufactured independently as opposed to being manufactured as a calibrated, matched pair. The LED module, by way of its controller, provides information to the PSU that allows the power supply to adjust its drive current appropriately. The PSU controller can also respond to operating temperature variations of the LEDs in order to provide thermal shutdown, brightness compensation, and other control if needed. In some embodiments, a controller in the PSU also responds to an external dimming input.

25 Claims, 12 Drawing Sheets

MODULARIZED LED LAMP

BACKGROUND

Light emitting diode (LED) lighting systems are becoming more prevalent as replacements for existing lighting systems. LEDs are an example of solid state lighting (SSL) and have advantages over traditional lighting solutions such as incandescent and fluorescent lighting because they use less energy, are more durable, operate longer, can be combined in red-blue-green arrays that can be controlled to deliver virtually any color light, and generally contain no lead or mercury. In many applications, one or more LED dies (or chips) are mounted within an LED package or on an LED module, which may make up part of a lighting unit, lamp, "light bulb" or more simply a "bulb," which includes one or more power supplies to power the LEDs. An LED bulb may be made with a form factor that allows it to replace a standard threaded incandescent bulb, or any of various types of fluorescent lamps. LEDs can also be used in place of florescent lights as backlights for displays.

For most LED lamps, LEDs may be selected to provide various light colors to combine to produce light output with a high color rendering index (CRI). The desired color mixing may be achieved, for example, using blue, green, amber, red and/or red-orange LED chips. One or more of the chips may be in a package with a phosphor or may otherwise have a locally applied phosphor. Due to variations in the light output and color reproduction of LED chips, LED lamps are typically individually calibrated at the time of production to take into account the specific LED chips' light output as a function of current, light color, and possibly other characteristics. Typically, LED lamps also include temperature monitoring, so that the LEDs' drive current can be automatically reduced in the case of overheating, and this temperature monitoring function must also be adjusted for the specific LED chips being used in a particular lamp. If the LED lamp supports external dimming, the dimming circuitry must take into account the color temperature changes at various current levels and corresponding light outputs in order to maintain a target color characteristic. The calibration adjustments necessary for each individual lamp ensure that the current output of the power supply under various conditions is appropriate for the specific LEDs used in each specific lamp.

SUMMARY

Embodiments of the present invention provide a modular LED lighting system that enables an LED lamp in which digital and/or analog communication takes place between the LED module and the power supply unit (PSU) of the lamp. A microcontroller in the LED module sends signals to the PSU, allowing modularization (separation) of the two parts (LED module and power supply), so that each part can be manufactured independently as opposed to as a matched pair. Functions including thermal shutdown, thermal dimming, and unit-by-unit brightness adjustment can be appropriately carried out by the PSU without calibrating the assembled lamp because the PSU controller can effectively gain "knowledge" of the LEDs in the LED module by communicating with the microcontroller in the LED module. Thermal brightness compensation and lifetime brightness compensation can also be implemented.

A lighting system according to example embodiments of the invention includes at least one LED and a power supply that can control current supplied to the LED or LEDs that provide illumination. A controller is associated with the LED or LEDs and is electrically connected to the power supply. The controller independently determines at least one operating parameter of the LED or LEDs, and signals the power supply accordingly. The power supply may be referred to as a power supply unit (PSU) and may also include a controller referred to as a PSU controller or a first controller. In such a case, the controller associated more directly with the LEDs may be referred to as an LED controller or a second controller.

The operating parameters determined by the LED controller can include an operating temperature determined from a sensor at the LEDs, or parameters determined by the LED controller from reading a memory associated with the LED controller. Parameters for which data is stored in a memory, memories, or any medium in the LED module can include a target color characteristic and target brightness, which can be determined at the time the LED module, is manufactured. A run time for the lamp or lighting system, which may be a total cumulative run time, can also be stored. A calibration value or values used to manage the LED module thermally and with respect to its brightness can also be stored. In some embodiments, signaling between the two parts of the lamp is carried out by pulse width modulation; however, analog or other signaling can also be used. In some embodiments an optical isolator interconnects the two controllers.

In example embodiments, a modularized LED lamp can be constructed from a power supply unit and an LED module that are manufactured separately. The LED module, by way of its controller, provides information to a PSU controller that allows the power supply to adjust its drive current so that the LEDs provide light of the target values in brightness and/or color while accounting for LED output variation. This communication between the two independently operating parts allows the parts to be interchangeable. In some embodiments, an operating temperature of the LED or LEDs as well as a calibration value or calibration values for temperature and brightness determination can be provided to the PSU by the LED controller. This information can be taken into account by the PSU controller by comparing the temperature to a threshold temperature so that the PSU controller can set the current output of the power supply and manage over-temperature conditions accordingly. It can also be taken into account to mange brightness in the face of operating temperature variation and total run time. In some embodiments, the PSU controller can also respond to an external dimming input.

DETAILED DESCRIPTION

Figure 1:
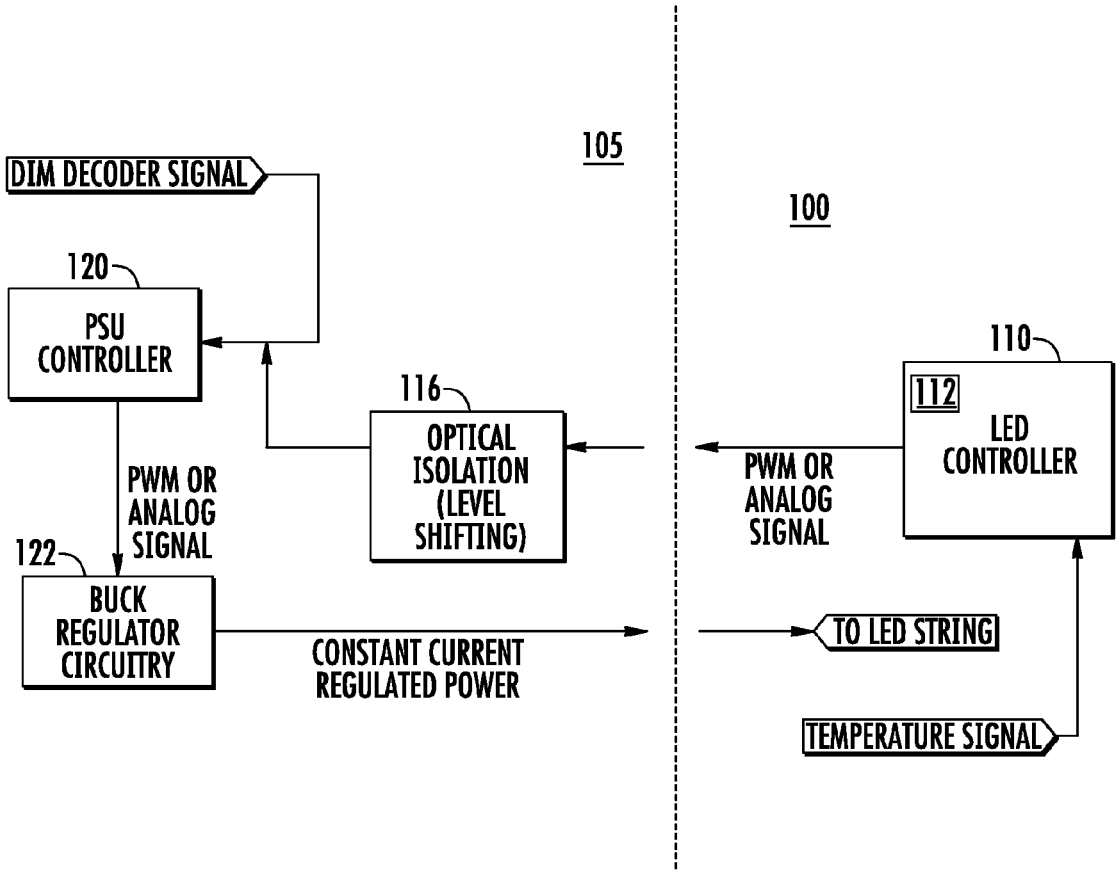
FIG. 1 is a functional block diagram of a lighting system according to example embodiments of the invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

Embodiments of the present invention entail digital and/or analog communication between a controller in an LED module of a solid state lamp, and a controller in a power supply unit that is supplying power to the LED module. The terms "controller", "module" and "unit" are used herein in the broadest sense. A controller can be a microcontroller, microprocessor, digital signal processor, embedded processor, programmed logic array, dedicated hard-wired circuitry, or any other electronics used to perform control functions. If a programmable device such as a microcontroller is used, firmware, software, or microcode can be stored in a tangible medium that is associated with the device. Such a medium may be a memory integrated into the controller, or may be a memory chip that is addressed by the controller to perform control functions. Such firmware, software or microcode is executable by a controller and when executed, causes the controller to perform its control functions.

Embodiments of the invention are described herein with reference to an LED "module" and a power supply "unit." These terms are intended in a broad sense to refer to a circuit board, electronic circuit, housing, or portion of a solid state lamp that includes the relevant functions. In example embodiments of the invention, a modularized or modular lamp is a lamp in which the LED module or portion with the LED chips, LED controller and relevant supporting circuitry is electrically and possibly mechanically interconnected with a power supply unit that supplies current to the LED module to drive the LED chips. Although these two assemblies can be connected to form a lamp, they can be manufactured separately and operate independently in a decision-making sense. By operating independently, what is meant is that the electronics in each makes independent decisions in a computer science sense, based on their electronic circuits, stored firmware and parameters, and the like; so that each can be connected with various compatible units of the other and still function. The term "independent" in this context does not mean that a lamp can necessarily operate with only one or the other or that they two are not electrically connected in a functioning solid-state lamp.

In example embodiments of the invention, a microcontroller on the LED circuit board sends signals to a pin on an controller for the power supply, allowing for the modularization (separation) of the two parts (LED module and power supply unit). This functional independence makes the two components interchangeable as opposed to being manufactured and calibrated as a matched pair, which cannot be separated. Thus, functions such as thermal shutdown, thermal dimming, unit-by-unit brightness adjustment, and unit-by-unit color adjustment can be accomplished with interchangeable parts despite part-to-part variation among LED chips that might be used in a lamp.

In example embodiments, the circuitry on the LED board monitors temperature and, in addition to other functions, sends a signal to the power supply unit, which can then reduce or shut off current to the LED board in the case that the temperature exceeds a safe range, referred to herein as an over-temperature condition. The circuitry on the LED board can also have information programmed into non-volatile memory at the time that the LEDs light output is measured during production. This information can include data representing brightness and color characteristics such as color temperature. Brightness data can be stored, and/or a brightness algorithm can be enabled to compensate for lifetime efficiency reduction of the LEDs, die-to-die variation of LED chips, and/or changes in the efficiency of the LEDs with temperature. These techniques for thermal brightness compensation, part variation brightness compensation, and lifetime brightness compensation can be used to give a lamp a constant, reliable light output, all while allowing modular construction that enables any power supply unit to work with any compatible LED module without individual calibration. Communication between the LED controller and the power supply unit controller in the modular parts of the lamp enables the power supply to adjust light output and color temperature for LED chips and/or LED arrays to desired target values in brightness (lumens) and/or color temperature to account for unit-to-unit variation among LED chips, so that the finished lamp does not need to be calibrated as a unit.

FIG. 1 is a functional block diagram of a lighting system that can be used to implement a modularized LED lamp according to example embodiments of the present invention. In FIG. 1, LED module 100 is connected to power supply unit (PSU) 105. In this example, LED controller 110 receives a temperature signal from a temperature sensor and includes on-board, non-volatile memory 112. In some embodiments temperature information is provided by the LED module to the PSU by an analog signal used to communicate the operating temperature based on the signal level. As an example, the analog signal can be produced by a digital to analog converter (DAC) in a microcontroller used for the LED controller. Alternatively, a pulse width modulation (PWM) signal could be used to communicate operating temperature based on duty cycle or frequency. In some embodiments, when the lamp initializes, the PWM signal can also provide data from memory 112 to the PSU by use of an agreed signaling protocol. These communication techniques are examples only; any or all of this information could be provided via a parallel bus, serial bit stream, or in various other ways.

Still referring to FIG. 1, power supply unit 105 includes optical isolation circuitry 116, which may be implemented by an opto-isolator. In example embodiments, circuitry 116 not only provides isolation, but also level-shifting since the LED module and PSU controllers and other circuitry may operate at different voltages and/or signaling levels. PSU controller 120 receives, at least, signaling from LED controller 110 through optical isolation circuitry 116. In example embodiments however, this signal is combined with a signal from a dim decoder which in turn receives an external dimming signal, for example, from a triac-based dimmer. A manner of combining the dimming signal from an external dimming input and a temperature signal from the LED module will be discussed below. PSU controller 120 in turn supplies power to buck regulator circuitry 122, which supplies drive current back to the LED string or array in LED module 100. In example embodiments, the drive current level can be set via PWM duty cycle, or an analog level can be used.

Figure 2:
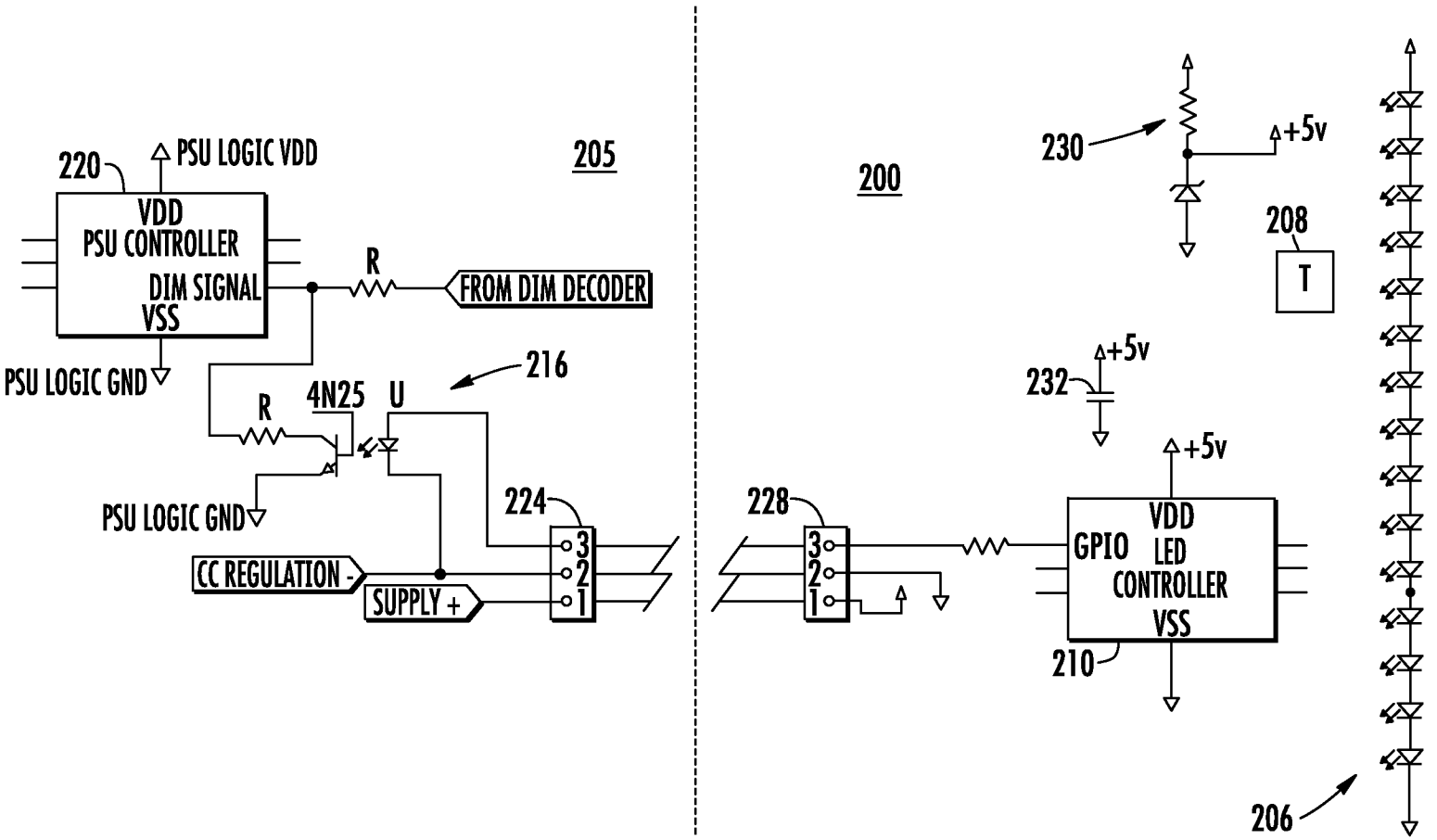
FIG. 2 is a schematic diagram of a lighting system according to example embodiments of the invention.

FIG. 2 is a partial schematic diagram of the lighting system of FIG. 1. Some detailed connections between components are omitted for clarity. The lighting system in FIG. 2 includes LED module 200 and PSU 205. LED module 200 includes LED string 206, temperature sensor 208 and LED controller 210. A 4N25 opto-isolator 216, which includes a light source and photo sensing transistor in one package, provides optical isolation. When a modularized lamp is assembled from PSU 205 and LED module 200, mating connections 224 and 228 interconnect the PWM signal from the general purpose I/O (GPIO) pin of LED controller 210 with opto-isolator 216, as well as the constant current (CC) supply line to drive LED string 206 and the supply voltage for the LED controller and any other electronics in the LED module. A voltage divider 230 and decoupling capacitor 232 between VSS and VDD on the LED module provide the stable five volts necessary to power LED controller 210.

As is apparent in the embodiment shown in FIG. 2, the dim decoder signal, buffered by an appropriate resistor, as well as the output from opto-isolator 216 can be fed into a dimming input in PSU controller 220. In such an embodiment the signals are superimposed so that either one can cause the PSU controller to reduce the constant current being used to drive LED string 206, but the absence of either signal cannot cause the current to be increased beyond the maximum allowed by the signal that is still present. Such functionality is accomplished by making the output of the PSU inversely proportional to the effective signal level at the dimming input. When the dim signal input for the PSU controller is zero, the constant current supplied to the LED chips is at its maximum allowed value. Increased signal at the dim input, whether in terms of the absolute voltage or the voltage over time as determined by a PWM duty cycle, causes the constant current to decrease and the LED light output to be reduced.

Figure 3:
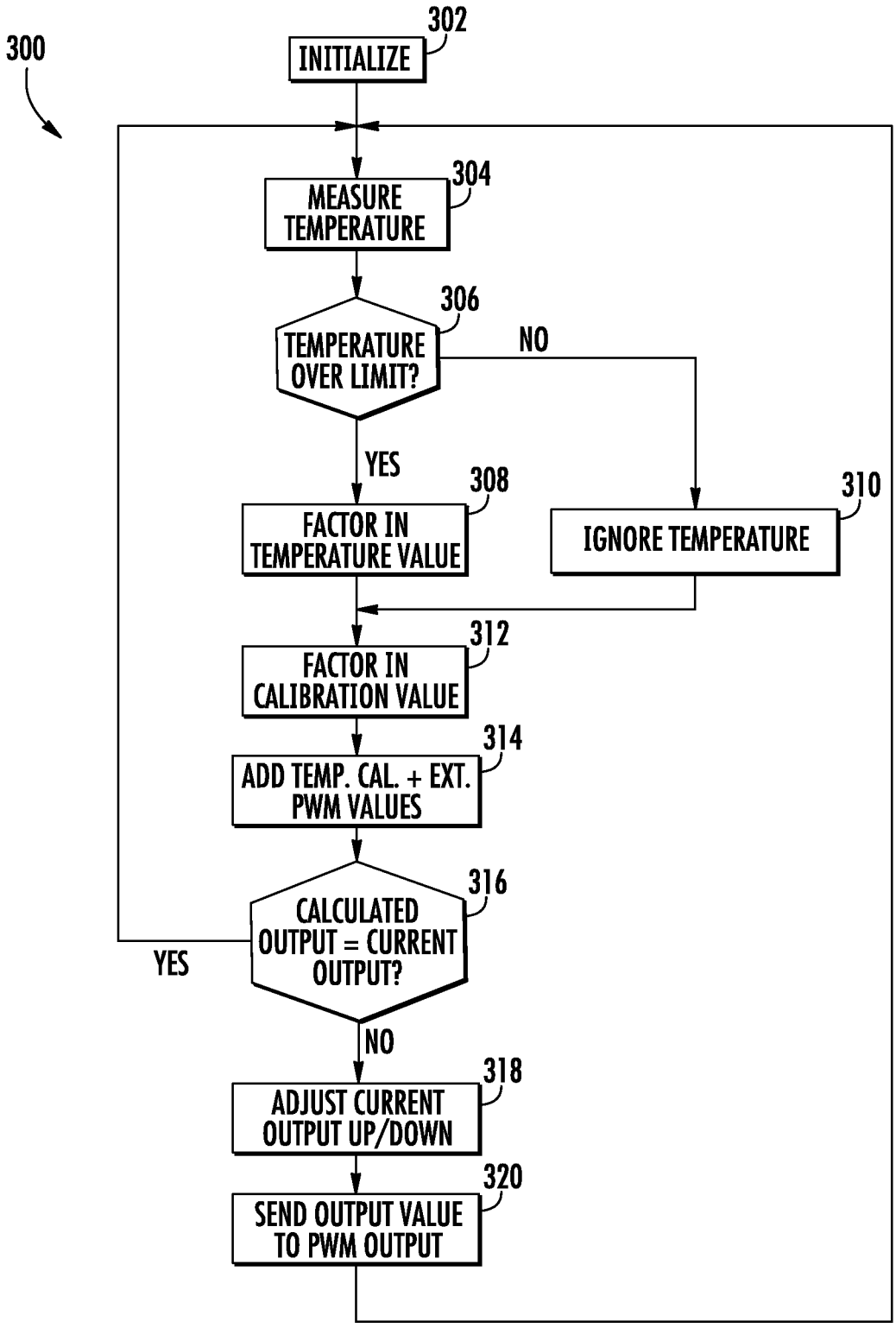
FIG. 3 is a flowchart showing the method of operation of a lighting system according to example embodiments of the invention.
Figure 4:
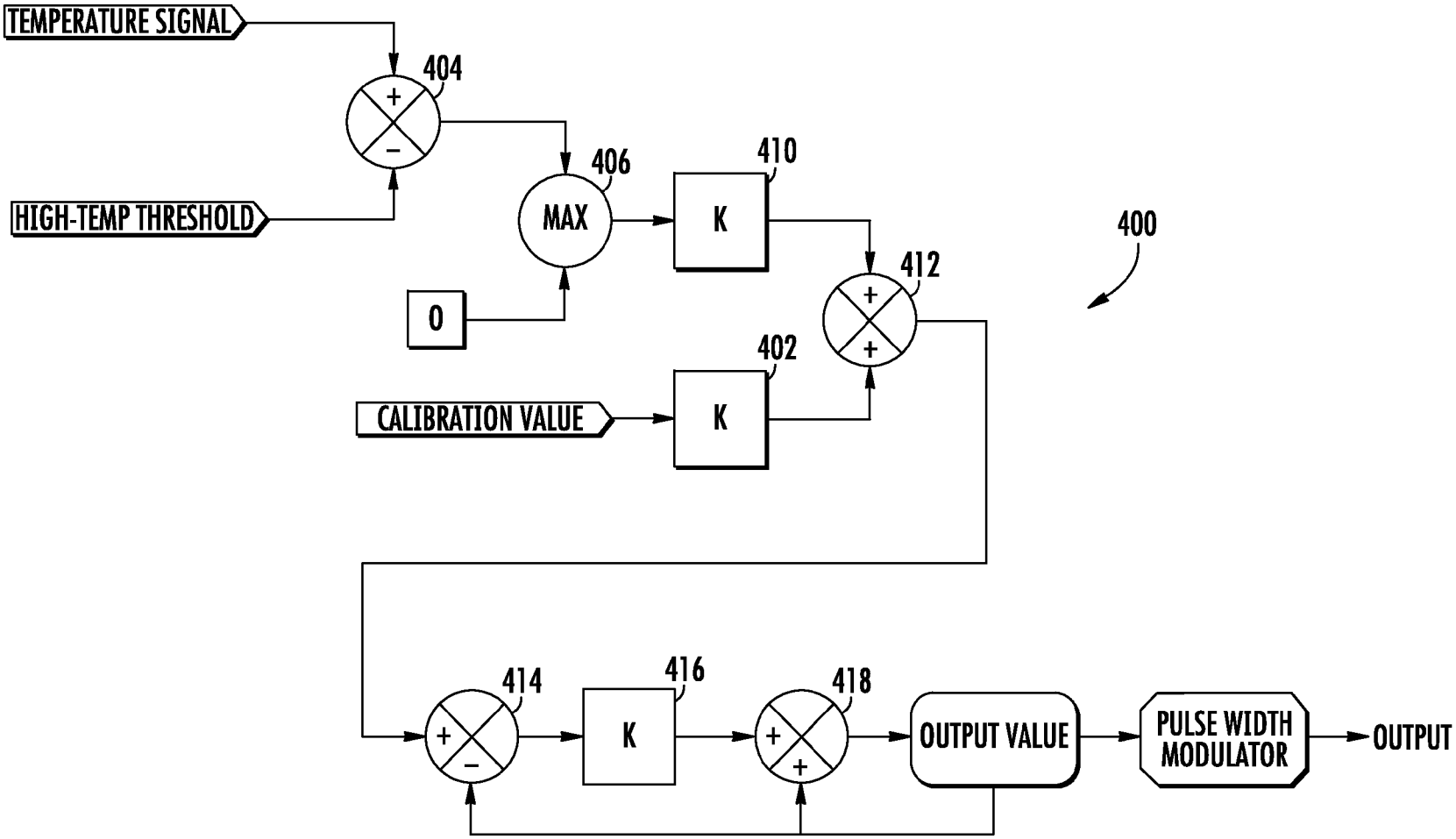
FIG. 4 is a processing flow diagram according to example embodiments of the invention. The processing flow diagram illustrates the processing involved in operating a lighting system according to example embodiments of the invention.

FIGS. 3 and 4 illustrate some of the processing involved in operating a lighting system according to example embodiments of the invention. The algorithms illustrated can be executed by one of both of the controllers in the example embodiments. For example, the temperature comparisons could be carried out in the LED controller, while the rest of the algorithm is carried out in the PSU controller. Alternatively, the LED controller could simply determine temperatures and report data from memory, while the PSU controller carries out most of the processing. As will be appreciated by one of skill in the art, executable code to carry out the processes illustrated may be embodied as a method, article, system, computer program product, or a combination of the foregoing. Any suitable tangible computer usable or computer readable medium may be utilized for a non-transitory computer program product to implement an embodiment of the invention. Firmware or computer program code to cause controllers or processors to execute the described processes may be stored in a computer system being used to test and develop a lighting system, for example, an optical or magnetic disk. In a lighting system, the firmware or code can be stored in memory either within or externally connected to the controllers or a controller in a solid state lamp.

Although either or both controllers can be used to implement an embodiment of the invention, in some embodiments, it is advantageous to put all the control "intelligence" regarding the LEDs in the LED module and use off-the-shelf electronics for the PSU. In such an embodiment, the PSU controller may not have special communication functions beyond a dimming input. Rather, the signal sent by the LED module microcontroller tailored to what the PSU controller is expecting to receive on its dim decoder pin. No customer software need be created or installed on or in the PSU.

Like most flowcharts, FIG. 3 illustrates a process executed by a processor as a series of functional process and/or subprocess blocks. Process 300 begins with initializing the system at block 302. At block 304 the present operating temperature of the LED chips or the LED module is acquired. At block 306 this temperature is compared to a stored threshold or limit temperature. If the current temperature is greater than the threshold value, a determination is made at block 306 to factor the present temperature in the calculations to be carried out to set the output drive current of the power supply, and a subtraction is performed to find the delta in order to factor the temperature value into the calculation at block 308. This difference temperature value needs to be scaled or multiplied by a stored calibration value at block 312 and added back to the calibration value at block 314. In an embodiment where an external dimming input is used, a value based on an external dimming signal is also added at block 314. The range of levels at the diming input of the PSU controller is set in this way so that the portion of that value contributed by the present temperature reading where the threshold is exceeded starts influencing the drive current a little bit above the threshold value, and proportionally influences the current with the maximum input at the maximum temperature. Otherwise, a decision is made to ignore the current temperature at block 310 and the dimming input level for the PSU controller is based only on the stored calibration value and a value contributed by the external dimming input.

Still referring to FIG. 3, whether the current temperature is taken into account or not, a determination is made at block 316 as to whether the present drive current output from the PSU is the same as what the PSU controller calculates as the correct output. If so, processing returns to the point where the current operating temperature of the LED module is measured at block 304. Otherwise, the current is adjusted at block 318 and the new value is sent to the PWM output of the PSU controller at block 320.

As previously mentioned, in example embodiments, the output of the PSU is inversely proportional to the effective signal level at the dimming input. The dimming signal corresponds to a numerical value that firmware in the LED module (and/or a dimming decoder responsive to an external dimming input) is generating. With respect to the signal from the LED module, the higher the value input to the opto-isolator, the more the signal causes the opto-isolator to pull down the drive current. So a value of 0 would cause the light output of the lamp to be at maximum, and a value of 255 (the highest value if 8-bit math is used) would correspond to a minimum light output. The calibration value in most embodiments is a fairly low number in order to make small tweaks to the overall brightness of the lighting system.

A more specific example of the above will now be discussed with reference to FIG. 4. The external dimming input is omitted from this example for clarity. If an LED module was measured slightly too bright at the factory, a calibration value of 5 might be stored in the memory associate with the LED controller. As can be seen in processing flow 400 of FIG. 4, the calibration value is always factored in to the dimming value as a constant at block 402, so that the dimming value has a minimum of 5 (to limit the maximum brightness) and a maximum of 255. If the temperature is lower than the threshold value (the temperature at which the hardware needs to start protecting itself) at block 404, temperature isn't factored in—it is counted as zero in the function at block 406. So for example, if the threshold is 80° C. and absolute max is 110° C., the range is 30°, which needs to influence the output over the range of 255, so starting with the temperature, subtract 80, and multiply by 8.5 at block 410. The controller adds the two values together at block 412.

In the above example, at 80° C. the dimming input is 5, at 90° C. the dimming input is (90−80)*8.5+5=90, and at 100° C. the dimming input is (100−80)*8.5+5=175. By 110° C. the dimming input would max out with a numerical value of 255. Blocks 414, 416 and 418 of the processing flow diagram of FIG. 4 carry out the comparing of the actual present output to the calculated current output and the subsequent adjustment when the two values are different. Therefore, in the most general case, the dimming input to the PSU controller in example embodiments of the invention can be expressed as: dimming input value=maximum(0, temperature−threshold) *factor+calibration value, which in the specific example above works out to be: dimming input value=maximum(0, temperature−80)*8.5+calibration value.

It should be noted that with respect to temperature sensing, additional calculations may be needed to account for non-linearities of the sensor used. In most cases, the non-linearity of a transducer can be described mathematically by a curve, which can be taken into account by including a look-up table in the system. In at least some embodiments, such a look-up table can be stored in the memory associated with the LED controller, along with any other stored data for the operating parameters of the LED chips or LED string.

Figure 5:
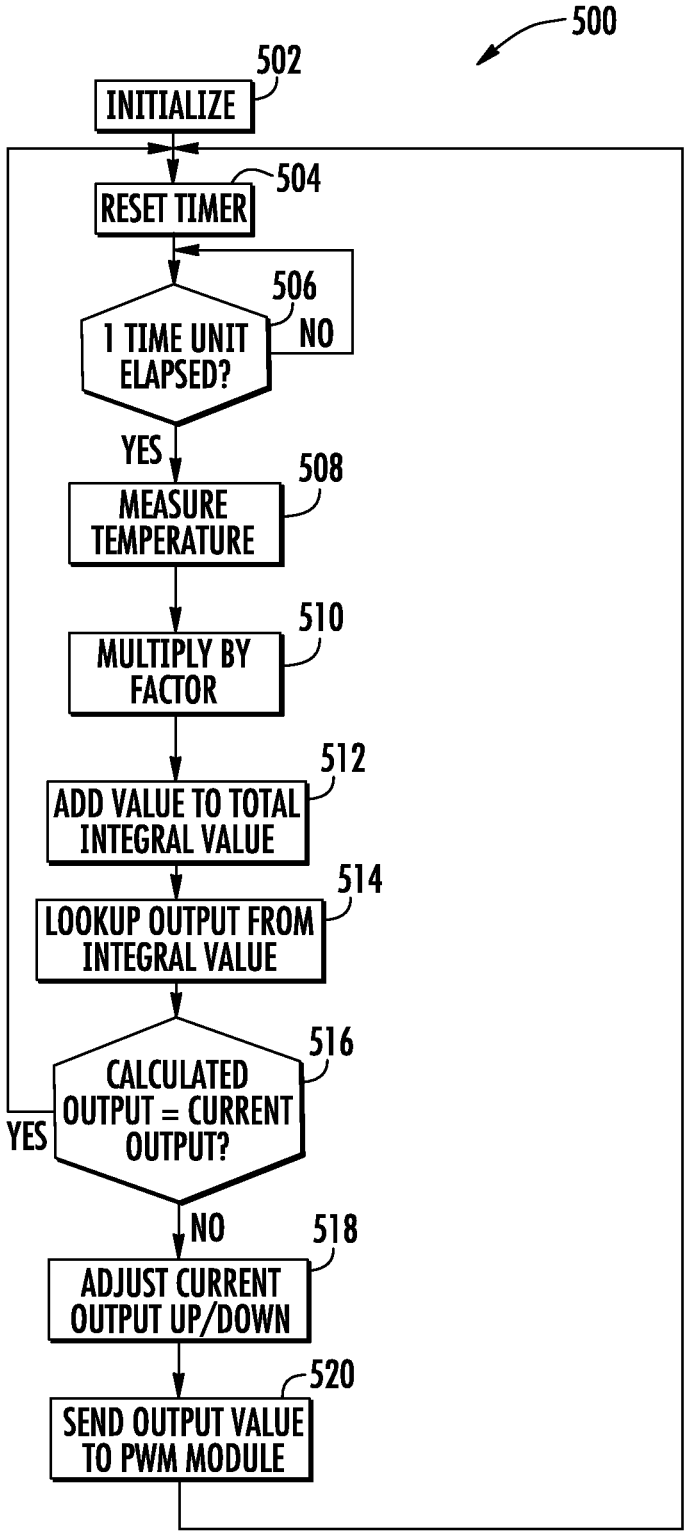
FIG. 5 is a flowchart showing an additional method of operation of a lighting system according to example embodiments of the invention.
Figure 6:
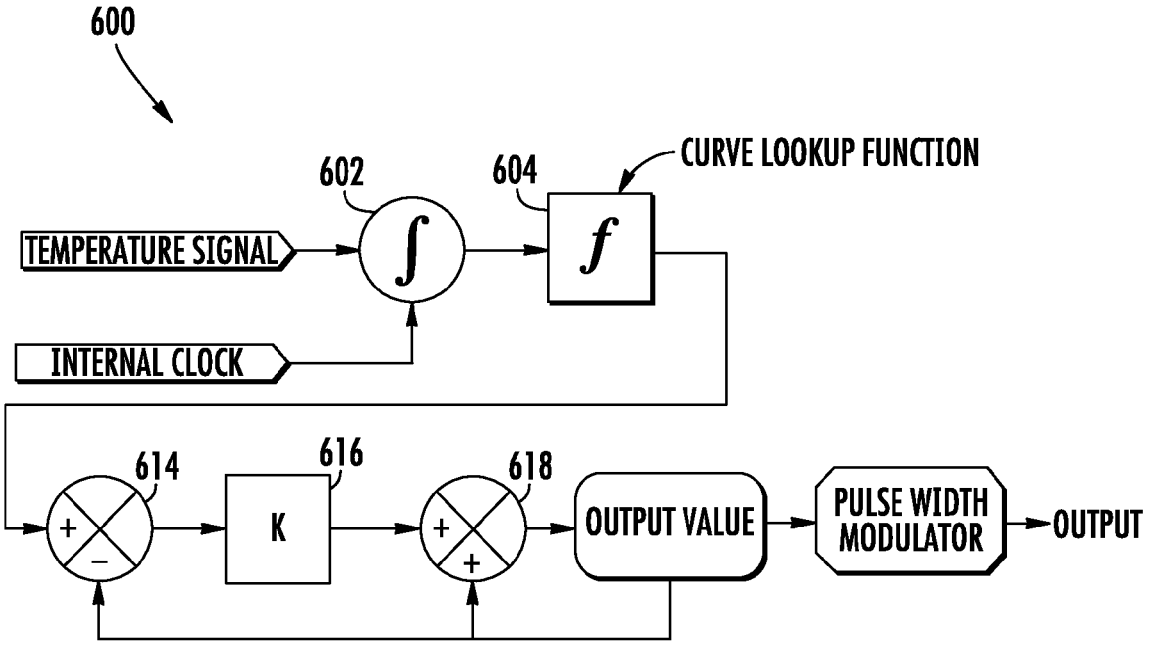
FIG. 6 is a processing flow diagram according to example embodiments of the invention. This processing flow diagram illustrates the processing involved in lifetime brightness compensation according to example embodiments of the invention.

FIGS. 5 and 6 illustrate some of the processing involved in implementing lifetime brightness compensation that can be used with some embodiments of the invention. As before, executable code to carry out the processes illustrated may be embodied as a method, article, system, computer program product, or a combination of the foregoing in any part of a lighting system, and may be combined with code to perform any or all of the other functions described herein. Over the useful life of an LED, efficiency gradually decreases so in most LED light fixtures the brightness will decrease gradually over long-term use. The LED module-PSU communication system of embodiments of the invention could be used to compensate for this loss of efficiency, creating an LED fixture or module that holds an exact or nearly exact lumen output over the entire life of the product. This technique involves very gradually increasing the drive current in response to an internal timer that keeps track of the product's total runtime over its entire life. Because an LED's degradation is heavily temperature-dependent, the process in at least some embodiments integrates LED temperature with respect to run time as determined by an internal clock to generate a total usage value which would be used in the calculation. This data can be stored either temporarily or permanently in a memory or other medium along with data for other parameters.

FIG. 5 illustrates a process executed by a processor as a series of functional process and/or sub-process blocks. Process 500 begins with initializing the system at block 502. At block 504 the timer for the LED module is set. In at least some embodiments, an updated, current observed state of the time is stored in memory. Processing waits for each iteration of the timer at block 506, and each time, the current temperature is measured at block 508. At block 510 the temperature is multiplied by a factor and at block 512 the result is added to a value based on the internal clock and the result is integrated, possibly using another look-up table at block 514. A determination is made at block 516 as to whether the present drive current output from the PSU is the same as what the PSU controller calculates as the correct output. If so, processing returns to the point where the where the timer is reset at block 504. Otherwise, the current is adjusted at block 518 and the new value is sent to the PWM output of the PSU controller at block 520. Note that the internal clock referred to herein is used to measure total run time over the life, or some portion of the life of the lamp and is distinct from any timer used to determine the iteration frequency of the algorithms disclosed herein.

A more specific example of the above will now be discussed with reference to FIG. 6. As can be seen in processing flow 600 of FIG. 6, the temperature value and clock value are integrated at block 602. At block 604, the lookup function to look up the integral value in a lookup table is executed. Blocks 614, 616 and 618 of the processing flow diagram of FIG. 6 carry out the comparing of the actual present output to the calculated current output and the subsequent adjustment when the two values are different.

Figure 7:
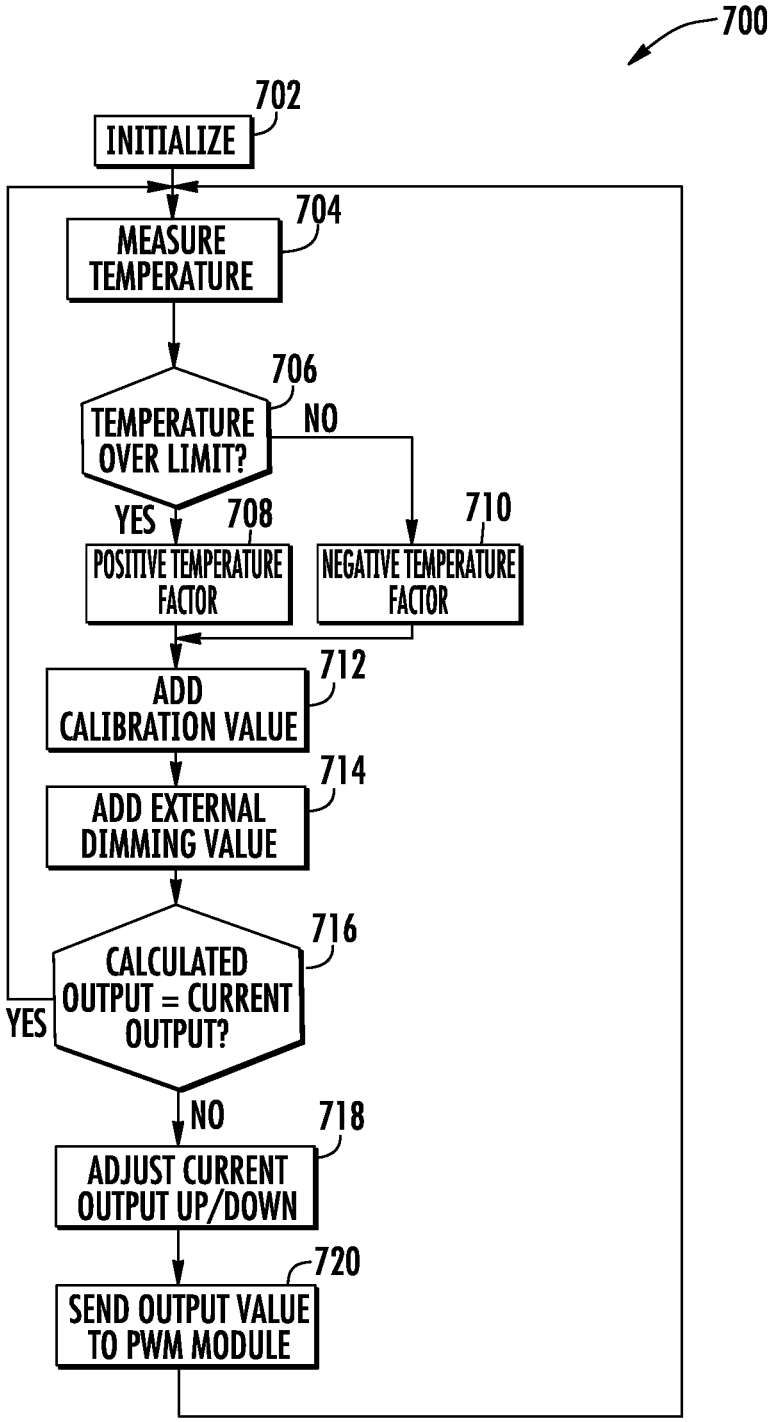
FIG. 7 is a flowchart showing an additional method of operation of a lighting system according to example embodiments of the invention. In this example, thermal brightness compensation is combined with some of the other methods of operation discussed herein.
Figure 8:
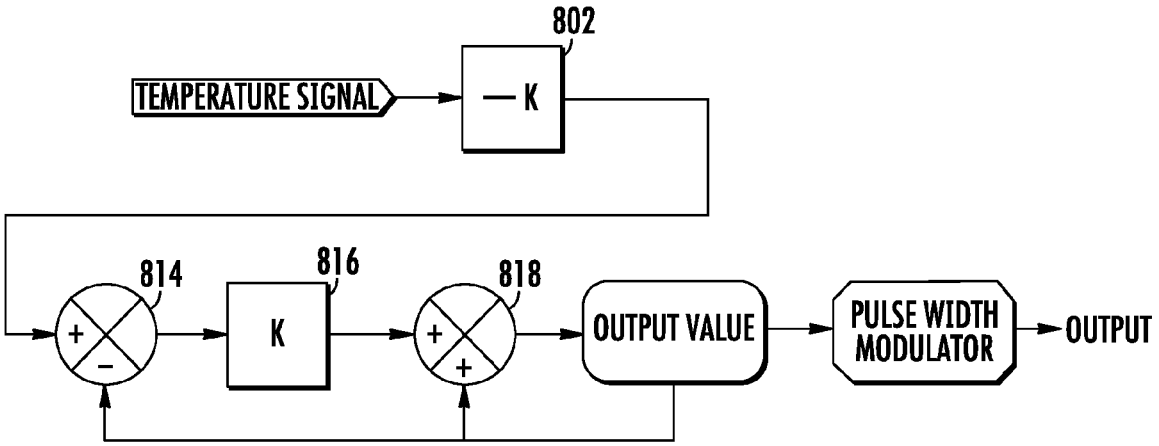
FIG. 8 is a processing flow diagram according to example embodiments of the invention. This processing flow diagram illustrates the processing involved in thermal brightness compensation according to example embodiments of the invention.
Figure 9:
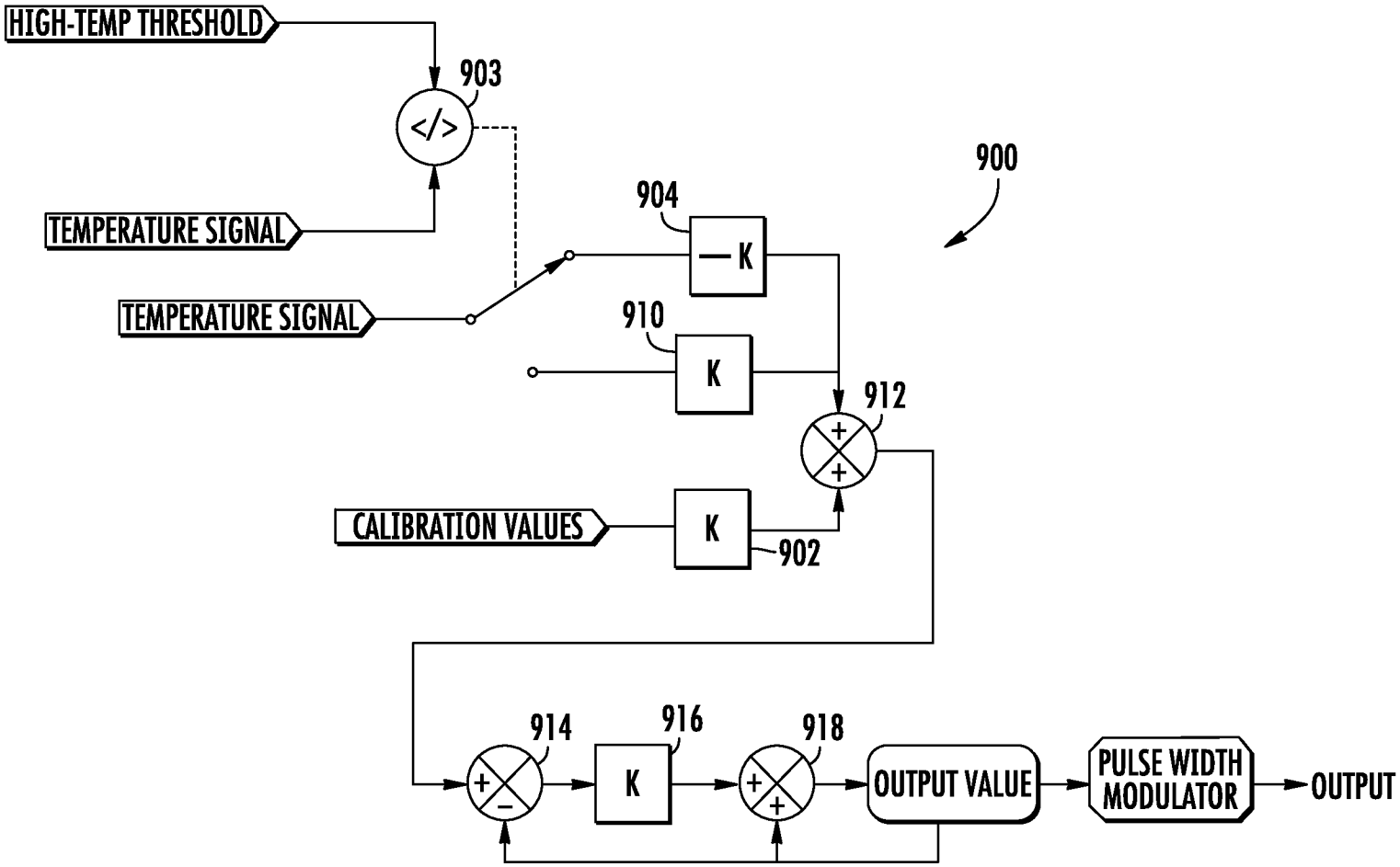
FIG. 9 is a processing flow diagram according to additional example embodiments of the invention. This processing flow diagram illustrates the combined processing involved in using thermal brightness compensation with over temperature protection.

FIGS. 7, 8 and 9 illustrate some of the processing involved in implementing thermal brightness compensation that can be used with some embodiments of the invention. In the case of the flowchart of FIG. 7 and the signal flow of FIG. 9, the thermal brightness compensation is combined with the over temperature protection previously described. As LEDs heat up, they become less efficient, so in most LED light fixtures the brightness will decrease as the fixture heats up. In some cases this change can be significant, perhaps resulting in 10-15% light reduction. Embodiments of the present invention can be used to compensate for this light reduction, creating an LED fixture or module that holds a substantially constant lumen output regardless of LED temperature. Note that this technique is distinct from the over-temperature protection previously described, which does not act until a threshold has been exceeded. The temperature compensation here is accomplished by starting with a dimmed signal when the LEDs are cold, and gradually increasing the current (by signaling less dimming to the PSU) as the LEDs heat up. The relationship of current increase to temperature is determined based on the characteristics of the LEDs and again, in some embodiments, generated from a stored lookup table. This temperature compensation function essentially does the opposite of the over temperature dimming function previously described, but both functions could be implemented together in the same system or fixture. Below the temperature limit threshold, temperature would be used in a calculation to proportionately increase current (by reducing the dimming signal) until the temperature reached the threshold. At that point, the software switches over to the over temperature algorithm to avoid dangerous temperatures.

FIG. 7 illustrates a process executed by a processor as a series of functional process and/or sub-process blocks. Both over temperature protection and temperature brightness compensation are included in the process illustrated in FIG. 7. Process 700 begins with initializing the system at block 702. At block 704 the present operating temperature of the LED chips or the LED module is acquired. At block 706 this temperature is compared to a stored threshold or limit temperature. If the current temperature is greater than the threshold value, a determination is made at block 706 to indicate a positive temperature factor at block 708 or a negative temperature factor at block 710. The temperature value needs to be scaled or multiplied by a stored calibration value at block 712 and the external dimming value is added at block 714. A determination is made at block 716 as to whether the present drive current output from the PSU is the same as what the PSU controller calculates as the correct output. If so, processing returns to the point where the current operating temperature of the LED module is measured at block 704. Otherwise, the current is adjusted at block 718 and the new value is sent to the PWM output of the PSU controller at block 720.

More specific examples of the above will now be discussed with reference to FIGS. 8 and 9. In signal flow 800 of FIG. 8, the temperature signal is modified by an inverse constant 802 to boost drive current with temperature increase to implement thermal brightness compensation. Again, blocks 814, 816 and 818 of the processing flow diagram of FIG. 8 carry out the comparing of the actual present output to the calculated current output and the subsequent adjustment when the two values are different.

Turning to FIG. 9, signal processing flow 900 illustrate the process where thermal brightness control and over-temperature protection are implemented together. A calibration lookup table that generates a calibration value 902 for the dimming range of the power supply is included as previously discussed. Block 903 compares the temperature to the stored threshold temperature for over-temperature protection, and controls a switch to apply either the thermal brightness compensation constant 904 or scaling constant 910, one of which is added to a the calibration value at block 912. Blocks 914, 916 and 918 of the processing flow 900 carry out the comparing of the actual present output to the calculated current output and the subsequent adjustment when the values are different.

Figure 10:
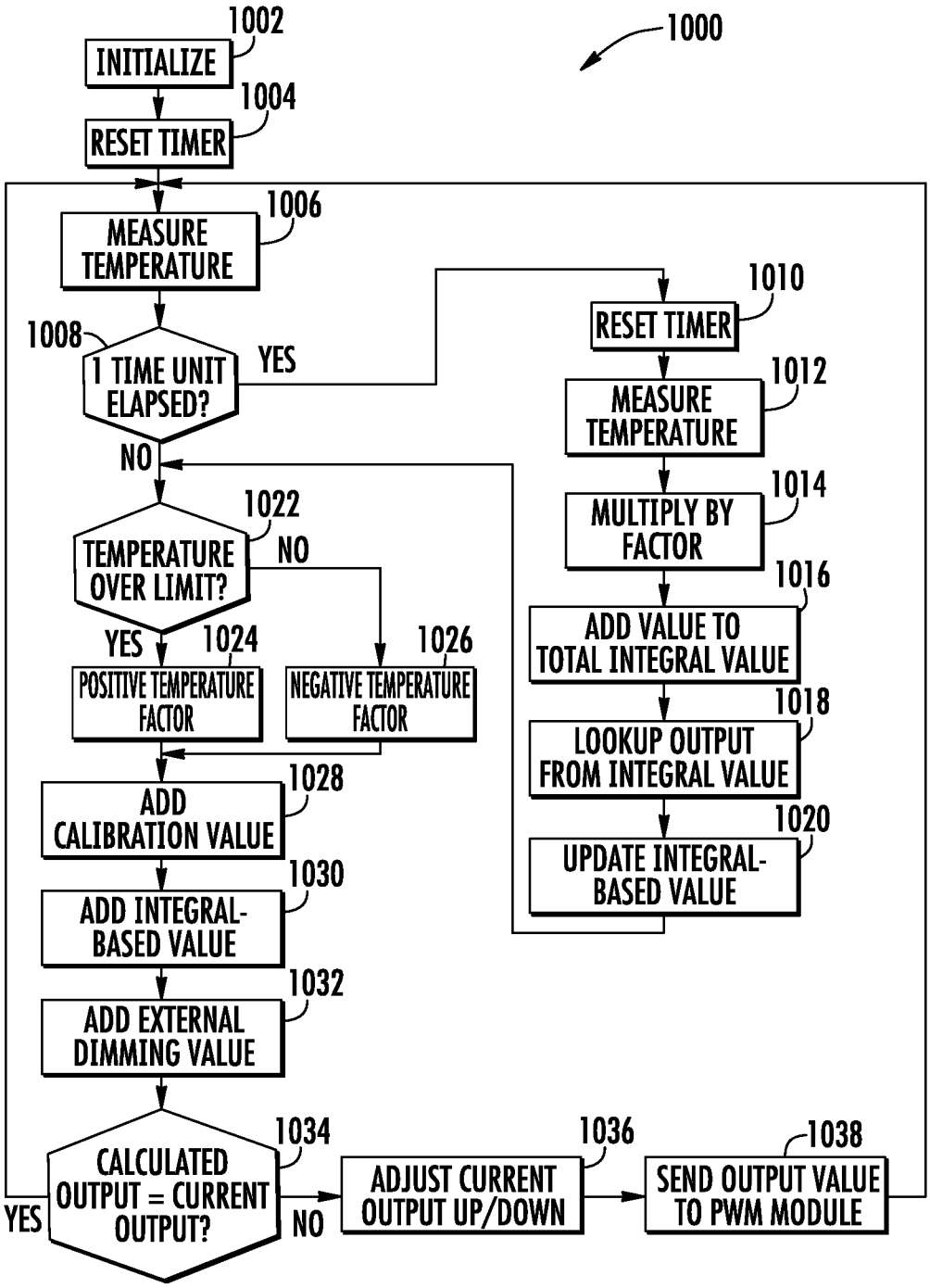
FIG. 10 is a flowchart showing a method of operation of a lighting system according to example embodiments of the invention in which many of the methods previously illustrated are combined.
Figure 11:
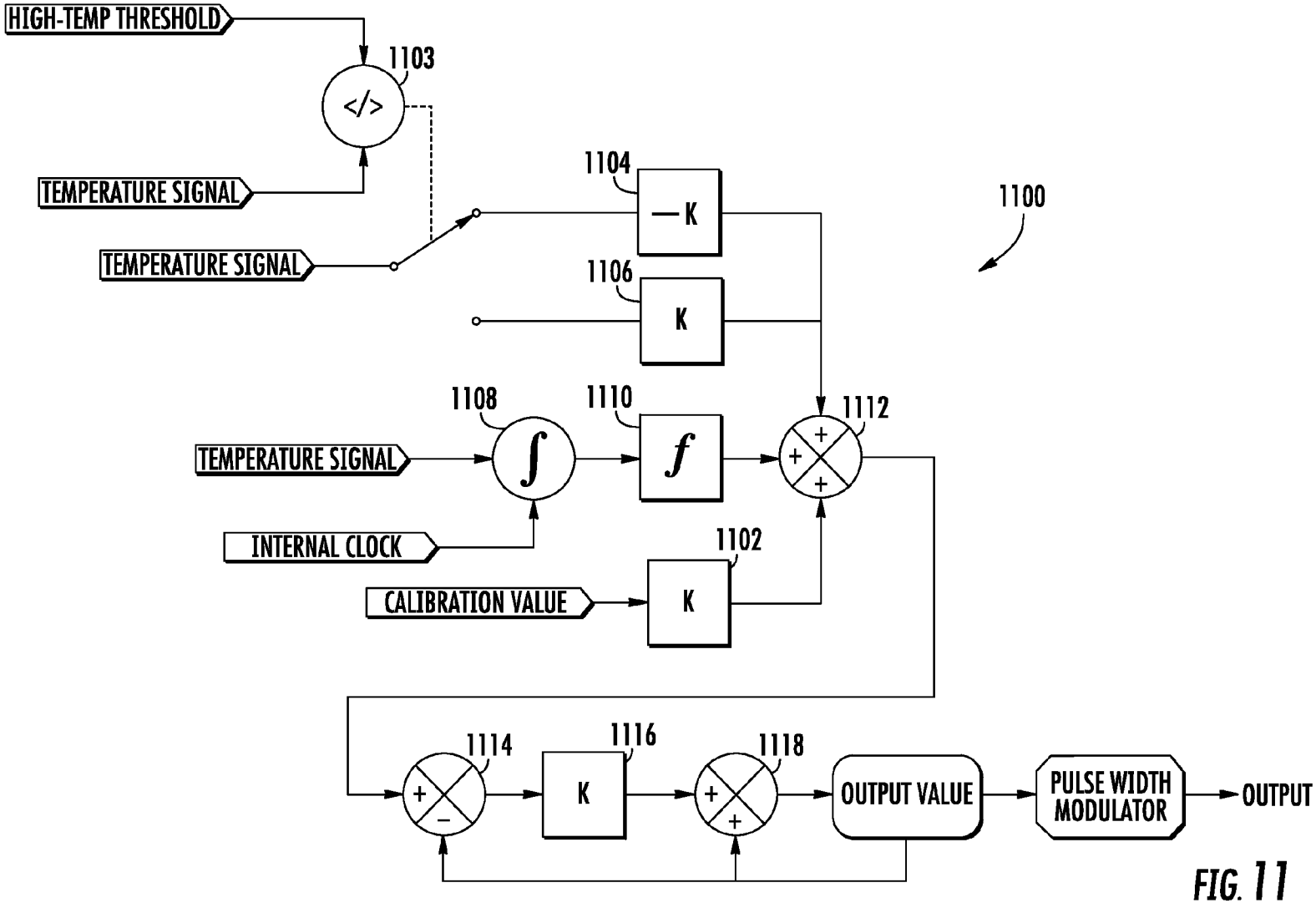
FIG. 11 is a processing flow diagram according to example embodiments of the invention. The processing flow diagram illustrates the processing involved in operating a lighting system where many of the methods previously illustrated are combined.

FIGS. 10 and 11 show a flowchart and signal processing flow diagram for a modular LED lamp or lighting system that is implementing thermal brightness compensation, over-temperature protection, lifetime brightness compensation and external dimming. Process 1000 of FIG. 10 begins with initialization at block 1002. At block 1004 the timer for the LED module is set. In at least some embodiments, an updated, current observed state of the timer is stored in memory. At block 1006 the present operating temperature of the LED chips or the LED module is acquired. Processing waits for each iteration of the timer at block 1008. Once a time unit has elapsed, the timer is reset again at block 1010 and the present operating temperature is again checked at block 1012. At block 1014 the temperature is multiplied by a constant factor as previously discussed and at block 1016 the result is added to a value based on the timer and the result is integrated, possibly using another stored look-up table at block 1018. The dimming input value is then updated at block 1020.

Still referring to FIG. 10, until a timer iteration at block 1008, if the current operating temperature is greater than the threshold value, a determination is made at block 1022 to indicate a positive temperature factor at block 1024 or a negative temperature factor at block 1026. The temperature value needs to be scaled or multiplied by a stored calibration value at block 1028. The current integral-based value for the PSU dimming input is added at block 1030, and a value based on an external dimming signal is also added at block 1032. A determination is made at block 1034 as to whether the present drive current output from the PSU is the same as what the controller calculates as the correct output. If so, processing returns to the point where the current operating temperature of the LED module is measured at block 1006. Otherwise, the current is adjusted at block 1036 and the new value is sent to the PWM output of the PSU controller at block 1038.

FIG. 11 shows signal processing flow 1100 illustrating more details of the process where thermal brightness compensation, over-temperature protection, lifetime brightness compensation and external dimming are all implemented in a modular lighting system. A calibration lookup table that generates a calibration value 1102 for the dimming range of the PSU is included as previously discussed. Block 1103 compares the temperature to the stored threshold temperature for over-temperature protection, and controls a switch to apply either the thermal brightness compensation constant 1104 or scaling constant 1106 to the dimming input value. The temperature value and internal clock value are integrated at block 1108. At block 1110, the lookup function to look up the integral value in a lookup table is executed. The various look-up table based and scaled values are added together at block 1112. As previously described, blocks 1114, 1116 and 1118 of the processing flow 900 carry out the comparing of the actual present output to the calculated current output and the subsequent adjustment when the values are different.

Figure 12:
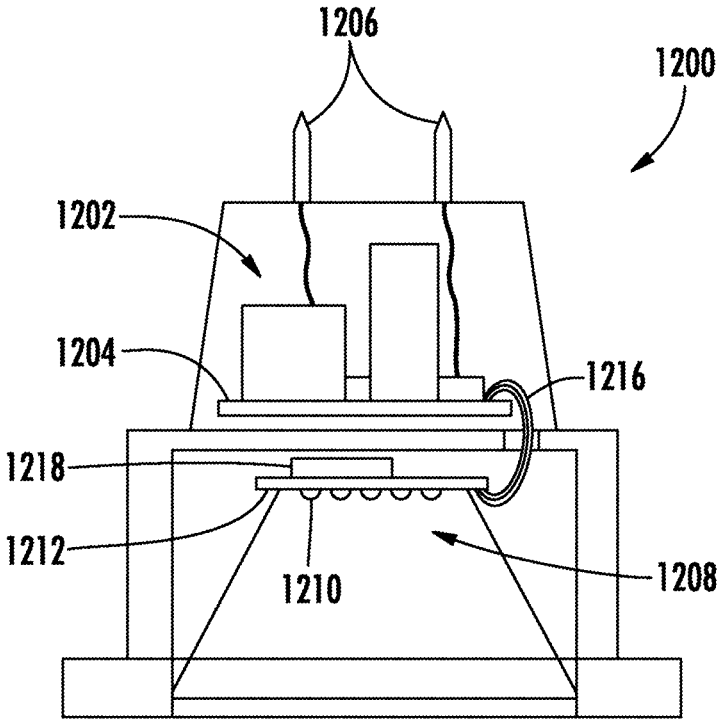
FIG. 12 is a modularized LED lamp according to example embodiments of the invention. The modularized LED lamp in FIG. 12 is implemented using a lighting system like that shown in FIG. 1 and FIG. 2.

FIG. 12 is a cross-sectional view of a modularized LED lamp according to example embodiments of the invention. Lamp 1200 is styled as an LED replacement for an "MR" type halogen lamp, such as an MR16. This styling and form factor is presented as an example only. The modular lighting system of embodiments of the invention can be embodied in any type or style of LED lamp. In addition, the PSU can include an AC/DC power supply, or a DC/DC power supply as might be required for some types of replacement lamps for DC powered applications. Lamp 1200 includes power supply unit 1202 including circuit board 1204 on which components are mounted and to which connection pins 1206 are connected by internal wires. Lamp 1200 also includes LED module 1208, which includes LED packages 1210, each containing at least one LED chip. The LED packages are mounted on circuit board 1212. Multi-chip packages of various sizes can also be used. In some embodiments, one or two multi-chip packages can provide the desired color and intensity of light, as discussed below. Internal electrical cable 1216 interconnects PSU 1202 and LED module 1208 and provides necessary power and signaling, including PWM signaling from the LED controller 1218 on the top side of circuit board 1212 to the PSU controller (not visible) on circuit board 1204.

It should be noted that the modularized nature of a lamp according to example embodiments of the invention can extend, or not, to all of the portions of the lamp. As previously described, the modularized nature of the lamp is primarily related to the electrical lighting system of the lamp. Thus, a lamp including a lighting system having independent electrical modules as previously described where those modules are installed in a unitary housing would still be considered a modularized lamp according to embodiments of the invention. A modularized lighting system might also be constructed where the independent PSU and LED modules resides in separate locations or housings, or within architectural components of a structure. However, a modularized lamp according to embodiments of the invention can also be constructed with an independent PSU and LED module, where each is complete with its own housing or housing portion, and where the two housings or housing portions are interconnected mechanically to assemble a lamp.

A multi-chip LED package used with an embodiment of the invention and can include light emitting diode chips that emit hues of light that, when mixed, are perceived in combination as white light. Phosphors can also be used. Blue or violet LEDs can be used in the LED assembly of a lamp and the appropriate phosphor can be deployed on a carrier within the lamp structure. LED devices can be used with phosphorized coatings packaged locally with the LEDs to create various colors of light. For example, a blue-shifted yellow (BSY) LED device can be used with a red phosphor on or in the carrier to create substantially white light, or combined with a red emitting LED device to create substantially white light. Such embodiments can produce light with a CRI of at least 70, at least 80, at least 90, or at least 95. By use of the term substantially white light, one could be referring to a chromacity diagram including a blackbody locus of points, where the point for the source falls within four, six or ten MacAdam ellipses of any point in the blackbody locus of points.

The various portions of an LED lamp according to example embodiments of the invention can be made of any of various materials. Heat sinks can be made of metal or plastic, as can the various portions of the housings for the components of a lamp. A lamp according to embodiments of the invention can be assembled using varied fastening methods and mechanisms for interconnecting the various parts. For example, in some embodiments locking tabs and holes can be used. In some embodiments, combinations of fasteners such as tabs, latches or other suitable fastening arrangements and combinations of fasteners can be used which would not require adhesives or screws. In other embodiments, adhesives, screws, bolts, or other fasteners may be used to fasten together the various components.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A modular LED lamp comprising:

an interchangeable LED module including an LED controller operable to independently determine at least one operating parameter for LEDs in the interchangeable LED module; and an interchangeable power supply unit (PSU) including a PSU controller to independently control current supplied to the interchangeable LED module by the interchangeable PSU in response to signaling from the LED controller, the interchangeable PSU further being interconnectable with the interchangeable LED module.

2. The modular LED lamp of claim 1 further comprising a memory associated with the LED controller, wherein the at least one operating parameter includes parameters represented by data stored in the memory.

3. The modular LED lamp of claim 2 wherein the at least one operating parameter comprises temperature.

4. The modular LED lamp of claim 3 wherein the PSU controller is operable to compare the temperature to a stored threshold temperature.

5. The modular LED lamp of claim 4 wherein the parameters further comprise a target brightness and a target color characteristic.

6. The modular LED lamp of claim 4 wherein the parameters further comprises a calibration value for temperature and brightness determination.

7. The modular LED lamp of claim 4 wherein the parameters further comprise a run time for the modular LED lamp.

8. The modular LED lamp of claim 4 wherein the signaling is accomplished through pulse width modulation.

9. The modular LED lamp of claim 8 further comprising an optical isolator connected between the PSU controller and the LED controller.

10. The modular LED lamp of claim 9 wherein the PSU controller is simultaneously responsive to an external dimming signal and the signaling from the LED controller.

11. A method of operating a modular LED lamp, the method comprising:

independently measuring a current temperature using an LED controller in an interchangeable LED module;

comparing the current temperature to a stored threshold temperature using a power supply unit (PSU) controller in an interchangeable power supply unit;

calculating an output current using the PSU controller at the interchangeable power supply unit based on the current temperature, the stored threshold temperature, and a stored calibration value; and independently setting the output current of the interchangeable power supply unit to supply the output current to the interchangeable LED module.

12. The method of claim 11 wherein the calculating of the output current further comprises taking the current temperature into account when the current temperature is greater than the stored threshold temperature.

13. The method of claim 11 wherein the calculating of the output current further comprises taking the run time of the modular LED lamp into account.

14. The method of claim 12 wherein the calculating of the output current further comprises responding to an external dimming signal.

15. The method of claim 14 wherein the calculating of the output is accomplished based in part on data stored in a memory in the interchangeable LED module.

16. The method of claim 15 wherein the data is representative of at least one of a target color characteristic and a target brightness.

17. An interchangeable LED module for a modularized LED lamp, the interchangeable LED module comprising:

at least one LED;

an LED controller operable to independently determine operating parameters for the at least one LED and to signal a power supply unit (PSU) controller in an interchangeable PSU;

a temperature sensor connected to the LED controller; and a memory associated with the LED controller to store at least one of the operating parameters.

18. The interchangeable LED module of claim 17 wherein the operating parameters further comprise a calibration value for temperature and brightness determination.

19. The interchangeable LED module of claim 18 wherein the LED controller signals the PSU controller using pulse width modulation.

20. The interchangeable LED module of claim 17 wherein the operating parameters further comprise at least one of a target brightness, a target color characteristic, and a run time for the interchangeable LED module.

21. An interchangeable power supply unit (PSU) for a modularized LED lamp, the interchangeable PSU comprising:

a current regulator to supply current to an interchangeable LED module; and a PSU controller to independently control the current in response to signaling from an LED controller in the interchangeable LED module.

22. The interchangeable PSU of claim 21 further comprising an optical isolator to receiving the signaling from the interchangeable LED module.

23. The interchangeable PSU of claim 22 wherein the PSU controller controls the current using pulse width modulation.

24. The interchangeable PSU of claim 23 wherein the PSU controller controls the current using an analog signal.

25. The interchangeable PSU of claim 22 wherein the PSU controller also controls the current in response to an external dimming signal.

* * * * *